US011145241B2

(12) United States Patent
Chen et al.

(10) Patent No.: US 11,145,241 B2
(45) Date of Patent: Oct. 12, 2021

(54) ELECTRONIC DEVICE AND PIXEL THEREOF

(71) Applicant: InnoLux Corporation, Miao-Li County (TW)

(72) Inventors: Lien-Hsiang Chen, Miao-Li County (TW); Kung-Chen Kuo, Miao-Li County (TW); Ming-Chun Tseng, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 0 days.

(21) Appl. No.: 16/535,329

(22) Filed: Aug. 8, 2019

(65) Prior Publication Data

US 2020/0090579 A1 Mar. 19, 2020

Related U.S. Application Data

(60) Provisional application No. 62/731,146, filed on Sep. 14, 2018.

(30) Foreign Application Priority Data

Apr. 12, 2019 (CN) ..... 201910294345.5

(51) Int. Cl.
*G09G 3/32* (2016.01)

(52) U.S. Cl.
CPC ..... *G09G 3/32* (2013.01); *G09G 2300/0842* (2013.01)

(58) Field of Classification Search
CPC ..... G09G 3/32; G09G 2300/0842
See application file for complete search history.

(56) References Cited

U.S. PATENT DOCUMENTS 10,553,152 B2 2/2020 Chen et al.
2003/0103022 A1 6/2003 Noguchi et al.
(Continued)

FOREIGN PATENT DOCUMENTS

CN 101192373 A 6/2008
CN 104715726 A 6/2015
(Continued)

OTHER PUBLICATIONS

Extended Search Report dated Feb. 4, 2020, issued in application No. EP 19194119.4.
(Continued)

*Primary Examiner* — Kenneth B Lee, Jr.
(74) *Attorney, Agent, or Firm* — McClure, Qualey & Rodack, LLP

(57) ABSTRACT

An electronic device including a pixel is provided. The pixel receives a data signal and includes a driving transistor, an emitting circuit, and a reset circuit. A first source/drain of the driving transistor receives a first operation voltage. The emitting circuit is coupled to the driving transistor. The reset circuit is coupled to the first gate to set the voltage of the first gate. In a reset period, the voltage of the first gate is equal to a first predetermined voltage. In a write period, the voltage of the first gate is equal to a first difference between the first operation voltage and the threshold voltage of the driving transistor. In a display period, the voltage of the first gate is equal to the sum of the first difference and a second difference between the reference voltage and the data signal.

13 Claims, 8 Drawing Sheets

(56) References Cited

U.S. PATENT DOCUMENTS

| | | | | |
|---|---|---|---|---|
| 2005/0259093 | A1 | 11/2005 | Osame et al. | |
| 2007/0236424 | A1 | 10/2007 | Kimura | |
| 2013/0057532 | A1 | 3/2013 | Lee et al. | |
| 2014/0062331 | A1 | 3/2014 | Nam et al. | |
| 2016/0267843 | A1* | 9/2016 | Wang | G09G 3/3258 |
| 2017/0025062 | A1* | 1/2017 | Wang | G09G 3/3233 |
| 2017/0140707 | A1 | 5/2017 | Xu et al. | |
| 2018/0047337 | A1 | 2/2018 | Zhu et al. | |
| 2018/0190185 | A1 | 7/2018 | Ko et al. | |

FOREIGN PATENT DOCUMENTS

| | | | |
|---|---|---|---|
| CN | 106486051 | A | 3/2017 |
| CN | 107492343 | A | 12/2017 |
| CN | 108234005 | A | 6/2018 |

OTHER PUBLICATIONS

Chinese language office action dated Sep. 2, 2020, issued in application No. CN 201910294345.5.
European Oral Proceedings dated Mar. 22, 2021, issued in application No. EP 19 194 119.4.

* cited by examiner

| | 310 | 381 | 351 | 371 | 321 | 341 | 342 |
|---|---|---|---|---|---|---|---|
| Reset period T310 | ○ | × | × | × | × | ○ | ○ |
| Write period T330 | ○ | ○ | ○ | × | × | × | × |
| Display period T350 | ○ | × | × | ○ | ○ | × | × |

FIG. 3C

ELECTRONIC DEVICE AND PIXEL THEREOF

CROSS REFERENCE TO RELATED APPLICATIONS

This application claims the benefit of U.S. Provisional Application No. 62/731,146, filed on Sep. 14, 2018, which is hereby incorporated by reference in its entirety.

This application claims priority of China Patent Application No. 201910294345.5, filed on Apr. 12, 2019, the entirety of which is incorporated by reference herein.

BACKGROUND OF THE DISCLOSURE

Field of the Disclosure

The disclosure relates to an electronic device, and more particularly to an electronic device that comprises a light-emitting component.

Description of the Related Art

Electronic devices are widely used as they possess the favorable advantages of having a thin profile, being light in weight, and emitting low levels of radiation. Generally, the display devices of these electronic devices comprise self-luminous display devices and non-self-luminous display devices. A non-self-luminous display device may use a backlight source to achieve the display function. Therefore, the size of a non-self-luminous display device is larger than the size of a self-luminous display device.

BRIEF SUMMARY OF THE DISCLOSURE

In accordance with an embodiment, an electronic device comprises a pixel. The pixel receives a data signal and comprises a driving transistor, an emitting circuit, and a reset circuit. The driving transistor comprises a first gate, a first source/drain and a second source/drain. The first source/drain receives a first operation voltage. The emitting circuit is coupled to the driving transistor. The reset circuit is coupled to the first gate to set the voltage of the first gate. In a reset period, the voltage of the first gate is equal to a first predetermined voltage. In a write period, the voltage of the first gate is equal to a first difference between the first operation voltage and the threshold voltage of the driving transistor. In a display period, the voltage of the first gate is equal to the sum of the first difference and a second difference, wherein the second difference is the difference between a reference voltage and the data signal.

In accordance with another embodiment, a pixel comprises a driving transistor, a lighting transistor, a light-emitting diode, a compensation transistor, a first reset transistor, a first capacitor and a second capacitor. The driving transistor comprises a first gate, a first source/drain and a second source/drain. The first source/drain receives a first operation voltage. The lighting transistor is coupled to the driving transistor and receives a lighting signal. The light-emitting diode comprises an anode coupled to the lighting transistor and a cathode receiving a second operation voltage. The compensation transistor is coupled between the first gate and the second source/drain and receives a scan signal. The first reset transistor comprises a second gate, a third source/drain and a fourth source/drain. The second gate receives a reset signal. The third source/drain receives a first predetermined voltage. The fourth source/drain is coupled to the first gate. The first capacitor is coupled between the first gate and the first source/drain. The second capacitor is coupled between the first gate and a node. In a reset period, the first reset transistor is turned on to transmit the first predetermined voltage to the first gate. In a write period, the compensation transistor and the driving transistor are turned on, and the voltage of the first gate is equal to a first difference between the first operation voltage and the threshold voltage of the driving transistor. In a display period, the driving transistor and the lighting transistor are turned on to light the light-emitting diode.

BRIEF DESCRIPTION OF THE DRAWINGS

The disclosure can be more fully understood by referring to the following detailed description and examples with references made to the accompanying drawings, wherein:

FIG. 3C is a state schematic diagram of an exemplary embodiment of the transistors shown in FIG. 3A according to an embodiment of the present disclosure.

DETAILED DESCRIPTION OF THE DISCLOSURE

Figure 1:
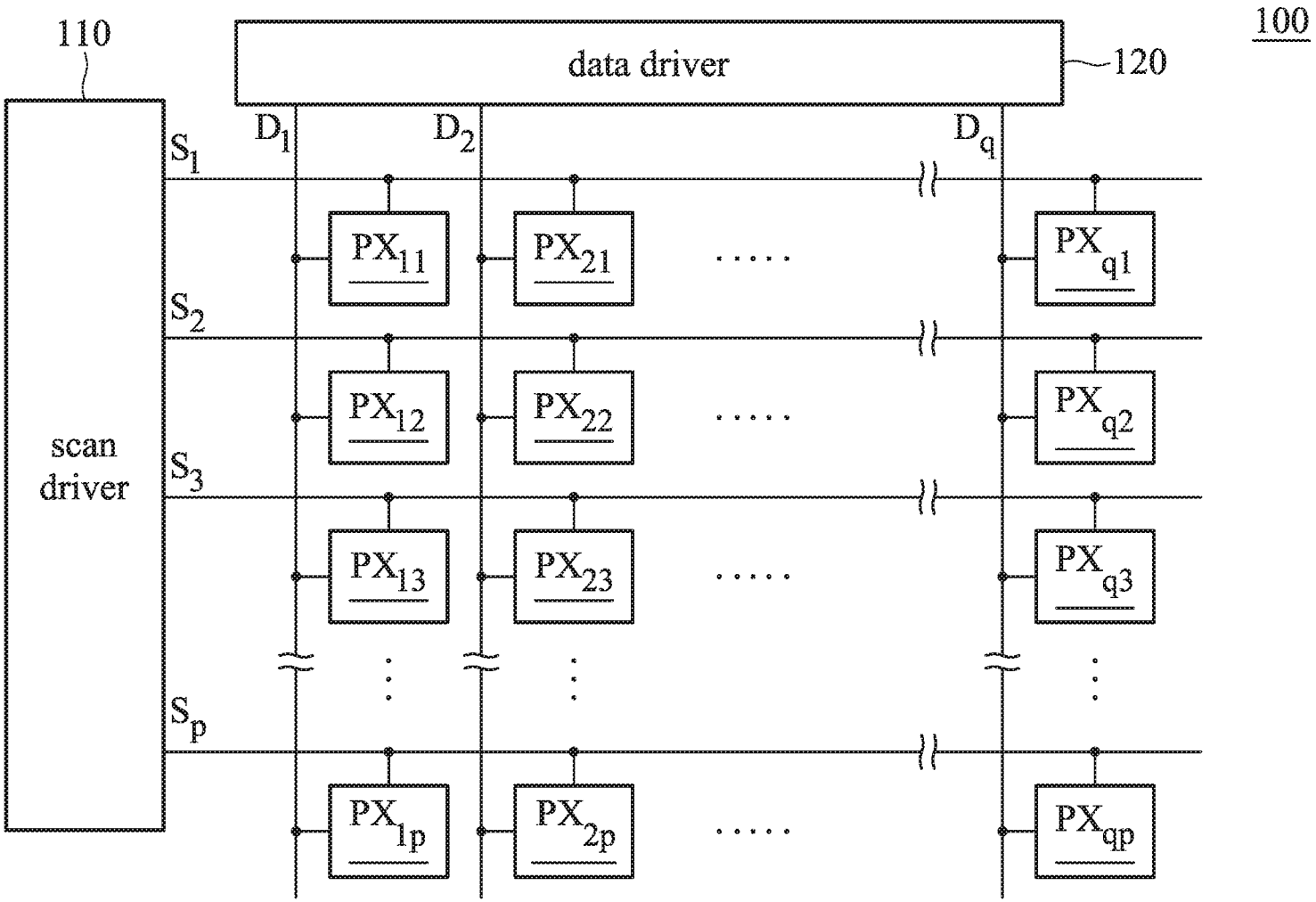
FIG. 1 is a schematic diagram of an exemplary embodiment of an electronic device according to various aspects of the present disclosure.

The present disclosure will be described with respect to particular embodiments and with reference to certain drawings, but the disclosure is not limited thereto and is limited by the claims. The drawings described are schematic and are non-limiting. In the drawings, the size of some of the elements may be exaggerated for illustrative purposes and not drawn to scale. The dimensions and the relative dimensions do not correspond to actual dimensions in the practice of the disclosure.

FIG. 1 is a schematic diagram of an exemplary embodiment of an electronic device according to various aspects of the present disclosure. In the present disclosure, the field of application of electronic devices is not limited. The electronic device may comprise a display device, a sensing device, an antenna device, any of a variety of appropriate devices, or combinations thereof. In one embodiment, the display device 100 is applied in a personal digital assistant (PDA), a cellular phone, a digital camera, a television, a global positioning system (GPS), a digital photo-frame, a notebook computer, a personal computer, an outdoor board or a spliced display, but the disclosure is not limited thereto.

As shown in FIG. 1, the display device 100 comprises a scan driver 110, a data driver 120 and a plurality of pixels $PX_{11}$~$PX_{qp}$. The scan driver 110 provides scan signals $S_1$~$S_p$. The data driver 120 provides data signals $D_1$~$D_q$.

The respective pixel among the pixels $PX_{11}$~$PX_{qp}$ receives a corresponding scan signal and a corresponding data signal. For example, the pixel $PX_{11}$ receives the scan signal $S_1$ and the data signal $D_1$. In this case, the pixel $PX_{11}$ receives the data signal $D_1$ according to the scan signal $S_1$ and provides the corresponding brightness according to the data signal $D_1$.

Figure 2A:
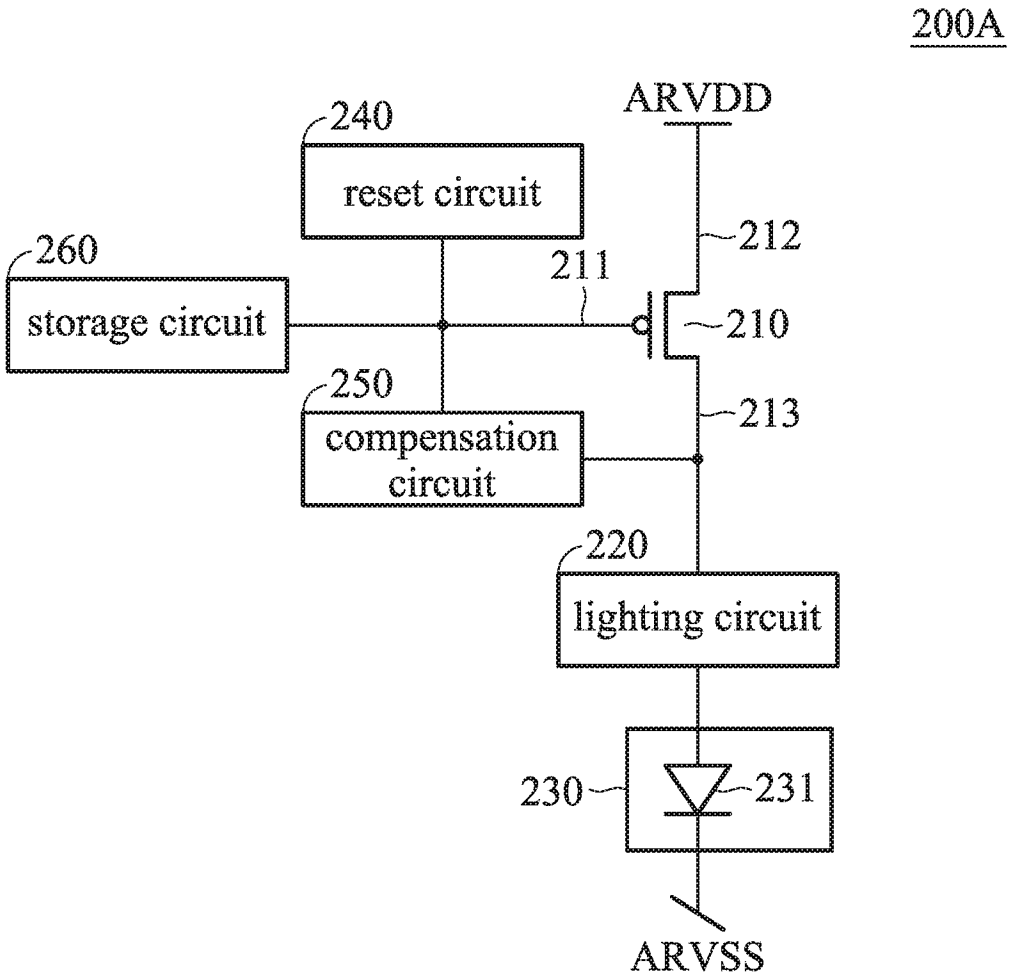
FIG. 2A is a schematic diagram of an exemplary embodiment of a pixel according to various aspects of the present disclosure.

FIG. 2A is a schematic diagram of an exemplary embodiment of a pixel according to various aspects of the present disclosure. Since the pixels $PX_{11}$~$PX_{qp}$ have the same circuit structures, FIG. 2A shows the circuit structure of one pixel. As shown in FIG. 2A, the pixel 200A comprises a driving transistor 210, a lighting circuit 220, a light-emitting circuit 230, a reset circuit 240, a compensation circuit 250 and a storage circuit 260.

The driving transistor 210 comprises a first gate 211, a first source/drain 212 and a second source/drain 213. The first gate 211 is coupled to the reset circuit 240, the compensation circuit 250 and the storage circuit 260. The first source/drain 212 receives a first operation voltage ARVDD. The second source/drain 213 is coupled to the lighting circuit 220 and the compensation circuit 250. In this embodiment, the driving transistor 210 may comprise a first P-type transistor. As shown in FIG. 2A, the gate of the first P-type transistor may be coupled to the reset circuit 240, the compensation circuit 250 and the storage circuit 260. The source of the first P-type transistor may receive the first operation voltage ARVDD. The drain of the first P-type transistor may be coupled to the lighting circuit 220 and the compensation circuit 250. The type of the driving transistor 210 is not limited in the preset disclosure. In other embodiments, the driving transistor 210 comprises an N-type transistor.

The lighting circuit 220 may be coupled to the driving transistor 210 to transmit a driving current to the emitting circuit 230. The circuit structure of the lighting circuit 220 is not limited in the present disclosure. Any circuit can serve as the lighting circuit 220, as long as the circuit is capable of transmitting a driving current.

The emitting circuit 230 is coupled to the lighting circuit 220 and receives a second operation voltage ARVSS. In this embodiment, the emitting circuit 230 is connected to the lighting circuit 220 and the driving transistor 210 in series between the first operation voltage ARVDD and the second operation voltage ARVSS. In one embodiment, the emitting circuit 230 may comprise a light-emitting component 231. The type of the light-emitting component 231 is not limited in the present disclosure. In one embodiment, the light-emitting component 231 may comprise a light-emitting diode (LED), an organic light-emitting diode (OLED), a mini LED, a micro LED, a Quantum Dot (QD), a QD LED referred to as a Q LED, any of a variety of appropriate light-emitting components, or combinations thereof, but the disclosure is not limited. In other embodiments, the light-emitting component in the emitting circuit 230 may have phosphors material or fluorescence material.

The reset circuit 240 may be coupled to the first gate 211 to set the voltage of the first gate 211. In the present disclosure does not limit the circuit structure of the reset circuit 240. Any circuit can serve as the reset circuit 240, as long as the circuit is capable of setting the voltage of the first gate 211.

The compensation circuit 250 may be coupled between the first gate 211 and the second source/drain 213. In this embodiment, the compensation circuit 250 is also configured to set the voltage of the first gate 211. In one embodiment, when the compensation circuit 250 turns on the path between the first gate 211 and the second source/drain 213, the driving transistor 210 is referred to as a diode-connected transistor.

The storage circuit 260 may be coupled to the first gate 211. In this embodiment, the driving transistor 210 operates according to the voltage stored in the storage circuit 260. In a reset period, the reset circuit 240 may set the voltage of the first gate to be equal to a first predetermined voltage. In a write period, the compensation circuit 250 turns on the path between the first gate 211 and the second source/drain 213. Therefore, the voltage of the first gate 211 may be equal to a first difference between the first operation voltage ARVDD and the threshold voltage of the driving transistor 210. In a display period, the driving transistor 210 generates a driving current according to the voltage stored in the storage circuit 260. At this time, the voltage of the first gate 211 may be equal to the sum of the first difference and a second difference, wherein the second difference is the difference between a reference voltage and a data signal. The second difference between the reference voltage and the data signal is described in greater detail below. In the display period, the lighting circuit 220 transmits the driving current generated by the driving transistor 210 to the emitting circuit 230.

Figure 2B:
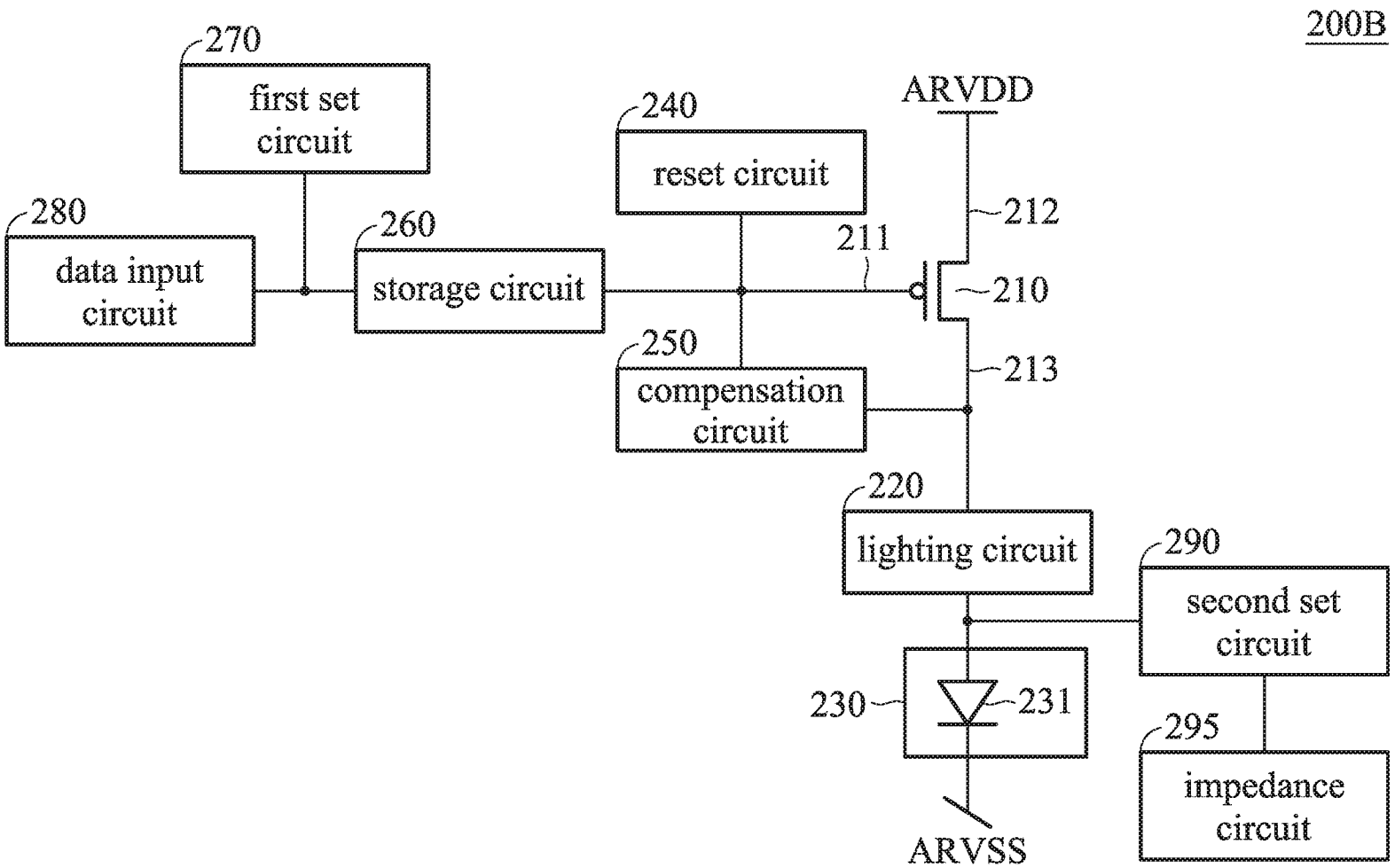
FIG. 2B is a schematic diagram of another exemplary embodiment of the pixel according to various aspects of the present disclosure.

FIG. 2B is a schematic diagram of another exemplary embodiment of the pixel according to various aspects of the present disclosure. FIG. 2B is similar to FIG. 2A exception that the pixel 200B of FIG. 2B further comprises a first set circuit 270. The first set circuit 270 may be coupled to the storage circuit 260 to set the voltage of an internal node of the storage circuit 260. For example, in the display period, the first set circuit 270 sets the voltage of the internal node to a reference voltage. The circuit structure of the first set circuit 270 is not limited in the present disclosure. Any circuit can serve as the first set circuit 270, as long as the circuit is capable setting the voltage of the internal node of the storage circuit 260.

In other embodiments, the pixel 200B further comprises a data input circuit 280. The data input circuit 280 is coupled to the storage circuit 260. In the write period, the data input circuit 280 transmits a data signal to the storage circuit 260 according to a scan signal. The present disclosure does not limit the circuit structure of the data input circuit 280. Any circuit can serve as the data input circuit 280, as long as the circuit is capable of transmitting a data signal to the storage circuit 260 according to a scan signal.

In another embodiment, the pixel 200B further comprises a second set circuit 290. The second set circuit 290 may be coupled to the anode or the cathode of the light-emitting component 231. For example, the second set circuit 290 may be coupled to the anode of the light-emitting component 231. The cathode of the light-emitting component 231 may receive other voltage or connect to a ground. In the reset period, the second set circuit 290 may set the voltage of the anode of the cathode of the light-emitting component 231 to be equal to a second predetermined voltage. The circuit structure of the second set circuit 290 is not limited in the present disclosure. Any circuit can serve as the second set circuit 290, as long as the circuit is capable of setting the voltage of the anode of the cathode of the light-emitting component 231.

In other embodiments, the pixel 200B further comprises an impedance circuit 295. The impedance circuit 295 may be coupled to the second set circuit 290. Before the light-emitting component 231 is formed, the tester may enable other circuits of the pixel 200B to generate a driving current, which is used to drive the light-emitting component 231. When the driving current passes through the impedance circuit 295, the voltage difference across the impedance circuit 295 is changed with change of the driving current. Therefore, the tester determines whether the driving current reaches a target value according to the voltage difference across the impedance circuit 295. If the driving current does not reach the target value, it means that the pixel 200B fails to operate correctly. At this time, the tester may replace the pixel 200B with a redundancy pixel or does not dispose the light-emitting component 231 in the pixel 200B.

Figure 3A:
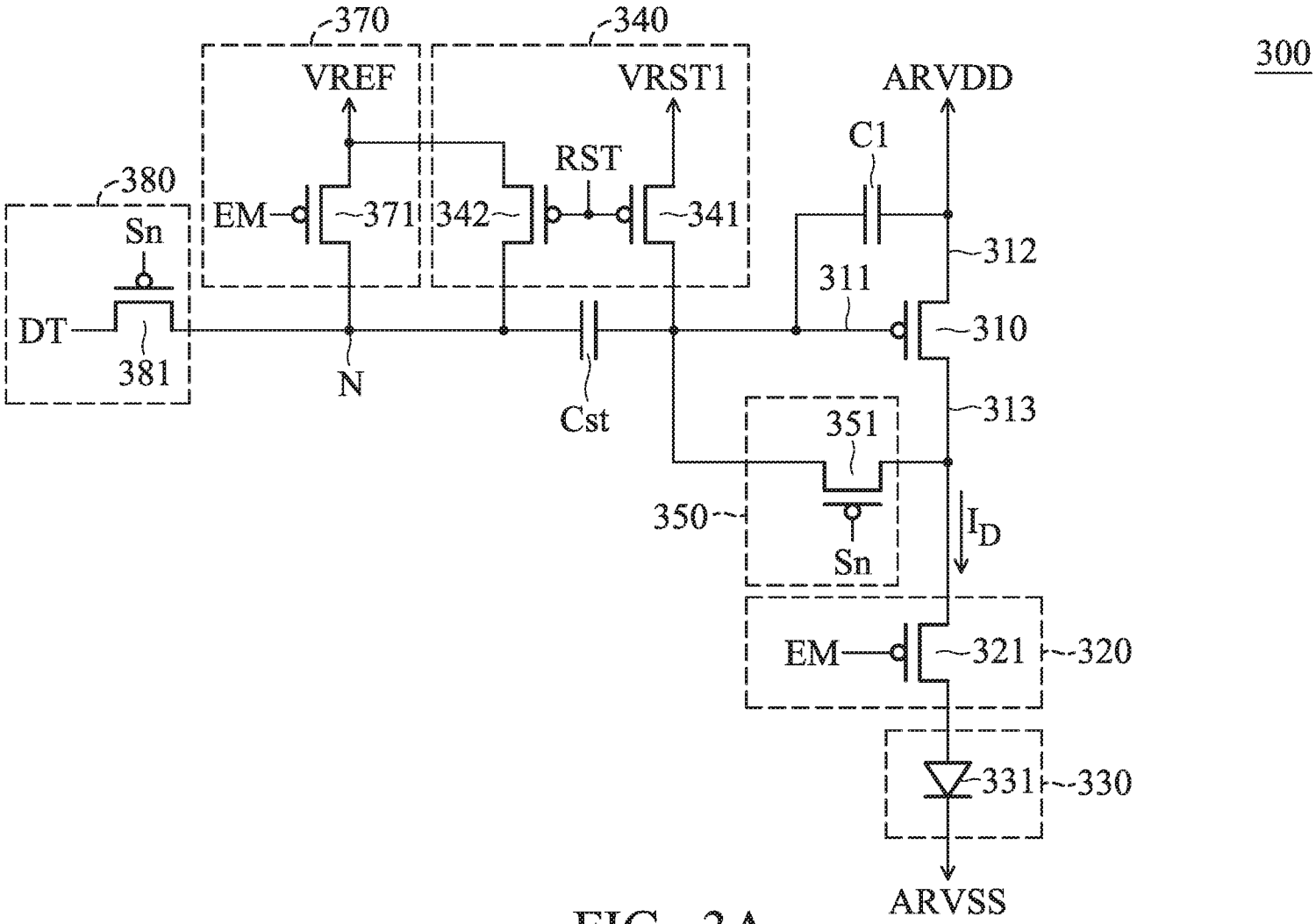
FIG. 3A is an equivalent circuit of the pixel according to an embodiment of the present disclosure.

FIG. 3A is an equivalent circuit of the pixel according to an embodiment of the present disclosure. As shown in FIG. 3A, the pixel 300 comprises a driving transistor 310, a lighting circuit 320, an emitting circuit 330, a reset circuit 340, a first set circuit 370, a data input circuit 380 and a storage circuit (C1 and Cst). In this embodiment, the driving transistor 310 comprises a first P-type transistor. The driving transistor 310 may comprise a first gate 311, a first source/drain 312 and a second source/drain 313. The type of driving transistor 310 is not limited in the present disclosure. In other embodiments, the driving transistor 310 may comprise an N-type transistor.

The lighting circuit 320 may comprise a lighting transistor 321. The lighting transistor 321 may be coupled between the driving transistor 310 and the emitting circuit 330 and receive a lighting signal EM. In a display period, the lighting transistor 321 is turned on to transmit a driving current $I_D$ to the emitting circuit 330. The type of lighting transistor 321 is not limited in the present disclosure. In this embodiment, the lighting transistor 321 comprises a P-type transistor. As shown in FIG. 3A, the gate of the P-type transistor receives the lighting signal EM. The source of the P-type transistor is coupled to the driving transistor 310. The drain of the P-type transistor is coupled to the emitting circuit 330. In other embodiments, the lighting transistor 321 comprises an N-type transistor.

The emitting circuit 330 may comprise a light-emitting component 331. The light-emitting component 331 is lighted according to the driving current $I_D$. In this embodiment, the anode of the light-emitting component 331 may be coupled to the lighting transistor 321. The cathode of the light-emitting component 331 may receive the second operation voltage ARVSS. The second operation voltage ARVSS is lower than the first operation voltage ARVDD. In one embodiment, the second operation voltage ARVSS is a ground voltage or a negative voltage.

The reset circuit 340 comprises a first reset transistor 341 and a second reset transistor 342, but the disclosure is not limited thereto. As shown in FIG. 3A, the first reset transistor 341 comprises a second gate, a third source/drain and a fourth source/drain. The second gate of the first reset transistor 341 may receive a reset signal RST. The third source/drain of the first reset transistor 341 receives a first predetermined voltage VRST1. The fourth source/drain of the first reset transistor 341 is coupled to the first gate 311. In a reset period, the first reset transistor 341 is turned on to transmit the first predetermined voltage VRST1 to the first gate 311.

The second reset transistor 342 comprises a third gate, a fifth source/drain and a sixth source/drain. The third gate of the second reset transistor 342 may receive the reset signal RST. The fifth source/drain of the second reset transistor 342 receives a reference voltage VREF. The sixth source/drain of the second reset transistor 342 is coupled to the node N. In the reset period, the second reset transistor 342 is also turned on to transmit the reference voltage VREF to the node N.

The types of first reset transistor 341 and the second reset transistor 342 are not limited in the present disclosure. In one embodiment, the first reset transistor 341 and the second reset transistor 342 comprise N-type transistors or P-type transistor. In other embodiments, the type of first reset transistor 341 may be different from the type of second reset transistor 342. For example, one of the first reset transistor 341 and the second reset transistor 342 comprises an N-type transistor and the other comprises P-type transistor. In this case, the gates of the first reset transistor 341 and the second reset transistor 342 may receive different reset signals, such as a first reset signal and a second reset signal, the phase of the first reset signal is opposite to the phase of the second reset signal. In this embodiment, the first reset transistor 341 may comprise a second P-type transistor. Furthermore, the second reset transistor 342 comprises a third P-type transistor.

The pixel 300 further comprises a compensation circuit 350. The compensation circuit 350 comprises a compensation transistor 351. The compensation transistor 351 may be coupled between the first gate 311 and the second source/drain 313 and receive a scan signal Sn. In a write period, the compensation transistor 351 is turned on such that the driving transistor 310 serves as a diode. The type of compensation transistor 351 is not limited in the present disclosure. In this embodiment, the compensation transistor 351 may comprise a P-type transistor. The gate of the P-type transistor receives the scan signal Sn. The source of the P-type transistor is coupled to the first gate 311. The drain of the P-type transistor is coupled to the second source/drain 313. In other embodiments, the compensation transistor 351 may comprise an N-type transistor.

The storage circuit comprises a first capacitor C1 and a second capacitor Cst. The first capacitor C1 is configured to stabilize the voltage of the first gate 311. As shown in FIG. 3A, the first terminal of the first capacitor C1 is coupled to the first gate 311. The second terminal of the first capacitor C1 is coupled to the first source/drain 312, but the disclosure is not limited thereto. In other embodiments, the second terminal of the first capacitor C1 may be coupled to a DC power source to receive a fixed voltage referred to as a third predetermined voltage. In one embodiment, the voltage provided by the DC power source is different from the first operation voltage ARVDD. The second capacitor Cst is coupled between the first gate 311 and the node N. In one embodiment, the capacitance of the first capacitor C1 may be lower than the capacitance of the second capacitor Cst.

The first set circuit 370 comprises a first set transistor 371. The first set transistor 371 comprises a fourth gate, a seventh source/drain and an eighth source/drain. The fourth gate of the first set transistor 371 may receive the lighting signal EM. The seventh source/drain of the first set transistor 371 may receive a reference voltage VREF. The eighth source/drain of the first set transistor 371 may be coupled to the node N. In a display period, the first set transistor 371 is turned on to transmit the reference voltage VREF to the node N. In this case, since the voltage of the node N is equal to the reference voltage VREF, the voltage stored in the first capacitor C1 can be maintained. The type of first set transistor 371 is not limited in the present disclosure. In this embodiment, the first set transistor 371 may comprise a P-type transistor. In some embodiments, the first set transistor 371 may comprise an N-type transistor.

The data input circuit 380 comprises a data input transistor 381. The data input transistor 381 is coupled to the node N and transmits the data signal DT to the node N according to the scan signal Sn. In a write period, the data input transistor 381 is turned on to transmit the data signal DT to the node N. The type of data input transistor 381 is not limited in the present disclosure. In one embodiment, the data input transistor 381 comprises a P-type transistor. In other embodiment, the data input transistor 381 comprises an N-type transistor.

Figure 3B:
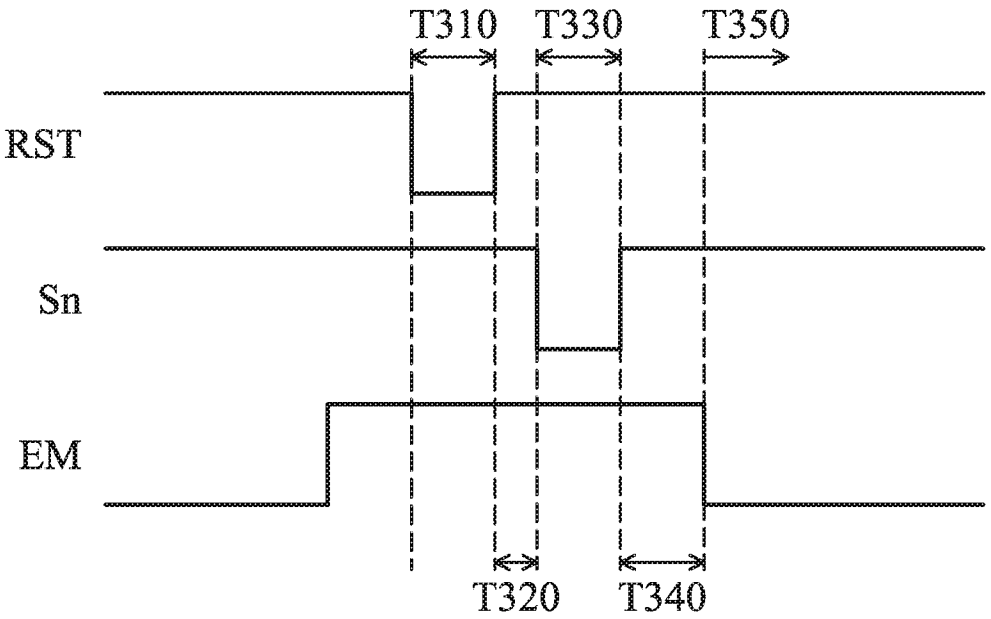
FIG. 3B is a control timing diagram of an exemplary embodiment of the pixel shown in FIG. 3A according to an embodiment of the present disclosure.

FIG. 3B is a control timing diagram of an exemplary embodiment of the pixel shown in FIG. 3A according to an embodiment of the present disclosure. FIG. 3C is a state schematic diagram of an exemplary embodiment of the transistors shown in FIG. 3A according to an embodiment of the present disclosure. As shown in FIGS. 3A~3C, in a reset period T310, the reset signal RST is at a low level. Therefore, the first reset transistor 341 and the second reset transistor 342 are turned on. At this time, the voltage of the node N is equal to the reference voltage VREF, and the voltage of the first gate 311 is equal to the first predetermined voltage VRST1. Since the voltage of the first gate 311 is equal to the first predetermined voltage VRST1 and the voltage of the first source/drain is equal to the first operation voltage ARVDD, the driving transistor 310 is turned on. Additionally, since the scan signal Sn and the lighting signal EM are at the high level, the data input transistor 381, the compensation transistor 351, the first set transistor 371 and the lighting transistor 321 are turned off.

In a write period T330, the scan signal Sn is at the low level to turn on the driving transistor 310, the data input transistor 381 and the compensation transistor 351. Since the data input transistor 381 is turned on, the voltage of the node N is equal to the data signal DT. Furthermore, since the driving transistor 310 and the compensation transistor 351 are turned on, the voltage of the first gate 311 is equal to a first difference (ARVDD−$V_{TH}$) between the first operation voltage ARVDD and the threshold voltage of the driving transistor 310.

In a display period T350, the lighting signal EM is at the low level. Therefore, the first set transistor 371 and the lighting transistor 321 are turned on. Since the first set transistor 371 is turned on, the voltage of the node N is equal to the reference voltage VREF. At this time, the voltage of the first gate 311 is equal to the first difference and a second difference due to the capacitance coupling effect. The second difference is a difference (VREF−DT) between the reference voltage VREF and the data signal DT. In other words, the voltage of the first gate 311 expressed by the following equation (1):

$$V_G = ARVDD - V_{TH} + (VREF - DT) \quad (1)$$

wherein $V_{TH}$ is the threshold voltage of the driving transistor 310, (ARVDD−$V_{TH}$) is the first difference, and (VREF−DT) is the second difference.

In the display period T350, the driving current $I_D$ generated by the driving transistor 310 is expressed by the following equation (2):

$$I_D = K(V_{SG} - V_{TH})^2 \quad (2)$$

wherein K is a conduction parameter.

If the gate voltage of the driving transistor 310 and the source voltage of the driving transistor 310 are substituted into equation (2), the substituted result is expressed by the following equation (3):

$$I_D = K(DT - VREF)^2 \quad (3)$$

According to equation (3), the driving current $I_D$ generated by the driving transistor 310 is not interfered by the threshold voltage of the driving transistor 310. Therefore, when the threshold voltage of the driving transistor 310 is shifted, the driving current $I_D$ does not be interfered. Additionally, in the display period T350, since the lighting transistor 321 is turned on, the lighting transistor 321 turns the driving current $I_D$ to the emitting circuit 330 to light the light-emitting component 331.

In this embodiment, a turning-off period T320 is between the reset period T310 and the write period T330. In the turning-off period T320, the reset signal RST and the scan signal Sn are at the high level to avoid that the data input transistor 381 and the second reset transistor 342 are turned on simultaneously, and the voltage of the node N is interfered. The duration of the turning-off period T320 is not limited in the present disclosure. In some embodiment, the turning-off period T320 can be omitted.

Furthermore, a turning-off period T340 is between the write period T330 and the display period T350. In the turning-off period T340, the lighting signal EM is at the high level to measure the voltage of the first gate 311 at a predetermined value. The duration of the write period T330 is not limited in the present disclosure. In one embodiment, the turning-off period T340 is longer than the turning-off period T320.

Figure 4:
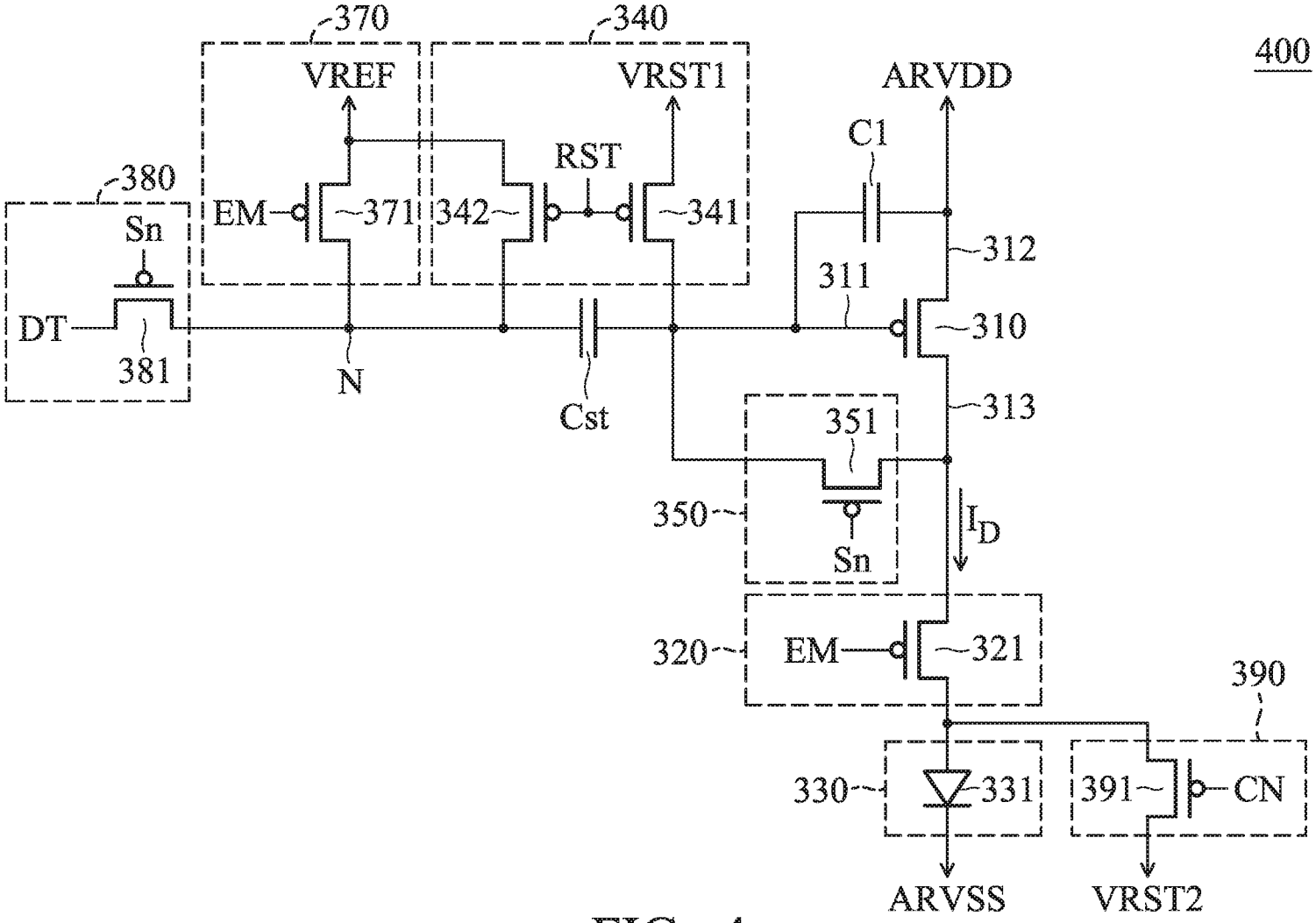
FIG. 4 is an equivalent circuit of the pixel according to another embodiment of the present disclosure.

FIG. 4 is an equivalent circuit of the pixel according to another embodiment of the present disclosure. FIG. 4 is similar to FIG. 3A exception that the pixel 400 shown in FIG. 4 further comprises a second set circuit 390. The second set circuit 390 comprises a second set transistor 391. In the reset period, the second set transistor 391 provides a second predetermined voltage VRST2 to the anode of the light-emitting component 331 according to a control signal CN to reset the voltage of the anode of the light-emitting component 331. In one embodiment, the second predetermined voltage VRST2 is lower than or equal to the second operation voltage ARVSS.

In other embodiments, the control signal CN is the previous scan signal (e.g., Sn−1) or the next scan signal (e.g., Sn+1). Taking FIG. 1 as an example, assume that the scan signals $S_1$~$S_p$ are sequentially asserted by the scan driver 110. If the scan signal $S_2$ is provided as the scan signal Sn, the scan signal $S_1$ or the scan signal $S_3$ can serve as the control signal CN. In some embodiment, the control signal CN may be the same as the scan signal Sn. Furthermore, the reset signal RST may be the previous scan signal (e.g., Sn−1). Taking FIG. 1 as an example, if the scan signal $S_2$ is served as the scan signal Sn, the scan signal $S_1$ can serve as the reset signal RST.

The type of second set transistor 391 is not limited in the present disclosure. In this embodiment, the second set transistor 391 may comprise a P-type transistor. In other embodiments, the second set transistor 391 may comprise an N-type transistor.

Figure 5:
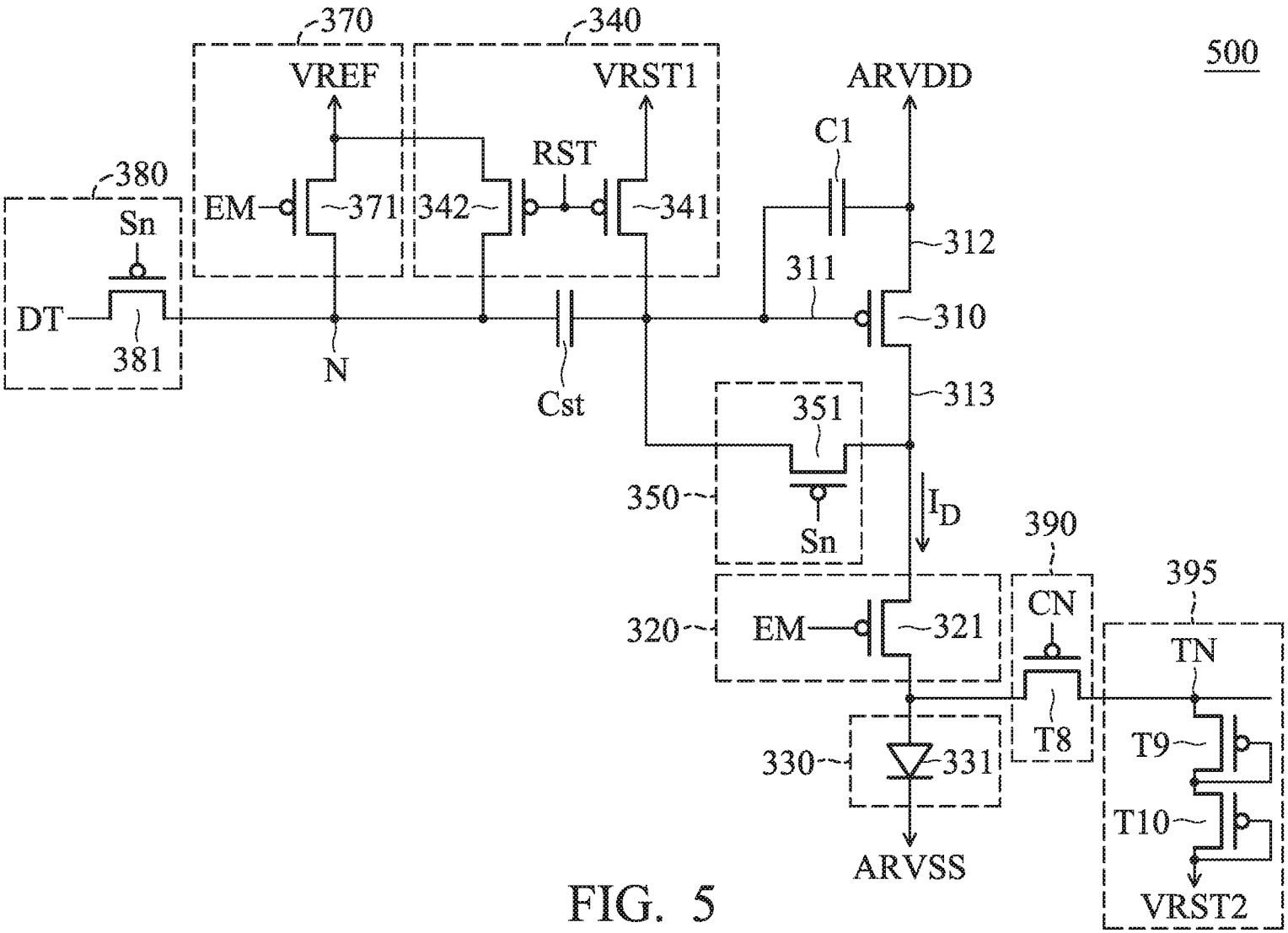
FIG. 5 is an equivalent circuit of the pixel according to another embodiment of the present disclosure.

FIG. 5 is an equivalent circuit of the pixel according to another embodiment of the present disclosure. FIG. 5 is similar to FIG. 4 exception that the pixel 500 of FIG. 5 further comprises an impedance circuit 395. The impedance circuit 395 may be coupled to the second set circuit 390 and receives the second predetermined voltage VRST2. In one embodiment, the second predetermined voltage VRST is equal to the second operation voltage ARVSS. In other embodiments, the second predetermined voltage VRST2 is lower than the second operation voltage ARVSS.

In this embodiment, when the light-emitting component 331 does not dispose in the pixel 500 yet, if all circuits in the pixel 500 are activated, the driving transistor 310 generates a driving current $I_D$ passing through the impedance circuit 395. The tester measures the voltage of the node TN to determine whether the driving current $I_D$ reaches a target value. If the driving current $I_D$ does not reach the target value, it means that the pixel 500 is not operating correctly.

At this time, the tester may try to repair the pixel 500 or replace the pixel 500 with a redundancy pixel. In one embodiment, when the pixel 500 is operating abnormal, the tester does not dispose the light-emitting component 331 in the pixel 500.

The materials of the semiconductor layers of the above transistors are not limited in the present disclosure. In one embodiment, the materials of the semiconductor layers of the above transistors may comprise amorphous silicon, polysilicon, low-temperature polysilicon (LTPS), oxide semiconductor, a variety of other material or combinations thereof. The oxide semiconductor may comprise indium gallium zinc oxide (IGZO).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. All features of the embodiments can be mixed and used as long as they do not violate the spirit of the disclosed or they do not conflict with each other.

While the disclosure has been described by way of example and in terms of the embodiments, it should be understood that the disclosure is not limited to the disclosed embodiments. On the contrary, it is intended to cover various modifications and similar arrangements (as would be apparent to those skilled in the art). For example, it should be understood that the system, device and method may be realized in software, hardware, firmware, or any combination thereof. Therefore, the scope of the appended claims should be accorded the broadest interpretation so as to encompass all such modifications and similar arrangements.

What is claimed is:

1. An electronic device comprising:

a pixel receiving a data signal and comprising:

a driving transistor comprising a first gate, a first source/drain and a second source/drain, wherein the first source/drain receives a first operation voltage;

a lighting transistor coupled to the driving transistor and receiving a lighting signal;

an emitting circuit coupled to the driving transistor and comprising a light-emitting diode which comprises an anode coupled to the lighting transistor and a cathode receiving a second operation voltage;

a compensation transistor coupled between the first gate and the second source/drain and receiving a scan signal;

a first reset transistor comprising a second gate, a third source/drain and a fourth source/drain, wherein the second gate receives a reset signal, the third source/drain receives a first predetermined voltage, and the fourth source/drain is coupled to the first gate;

a first capacitor coupled between the first gate and the first source/drain;

a second capacitor coupled between the first gate and a node; and a reset circuit coupled to the first gate to set a voltage of the first gate, wherein:

in a reset period, the voltage of the first gate is equal to the first predetermined voltage and the emitting circuit receives a second predetermined voltage, in a write period, the voltage of the first gate is equal to a first difference between the first operation voltage and a threshold voltage of the driving transistor, and in a display period, the voltage of the first gate is equal to a sum of the first difference and a second difference, wherein the second difference is a difference between a reference voltage and the data signal, wherein the second predetermined voltage is lower than or equal to the second operation voltage.

2. The electronic device as claimed in claim 1, further comprising:

a data input circuit coupled to the storage circuit, wherein in the write period, the data input circuit transmits the data signal to the storage circuit according to the scan signal.

3. The electronic device as claimed in claim 1, further comprising:

a first set circuit coupled to the node, wherein in the display period, the first set circuit sets a voltage of the node to be equal to the reference voltage.

4. The electronic device as claimed in claim 3, wherein the electronic device further comprises a second set circuit coupled to the anode of the light-emitting diode, wherein in the reset period, the second set circuit sets a voltage of the anode to be equal to the second predetermined voltage.

5. The electronic device as claimed in claim 4, further comprising:

an impedance circuit coupled to the second set circuit and receiving the second predetermined voltage.

6. The electronic device as claimed in claim 1, wherein the first reset transistor is a P-type transistor, and wherein in the reset period, the first reset transistor is turned on to transmit the first predetermined voltage to the first gate.

7. The electronic device as claimed in claim 6, further comprising:

a second reset transistor comprising a third gate, a fifth source/drain and a sixth source/drain, wherein the third gate receives the reset signal, the fifth source/drain receives the reference voltage and the sixth source/drain is coupled to the node, wherein in the reset period, the second reset transistor is turned on to transmit the reference voltage to the node, and the second reset transistor is a P-type transistor.

8. The electronic device as claimed in claim 1, wherein the driving transistor comprises a P-type transistor which comprises a gate coupled to the storage circuit, a source receiving the first operation voltage and a drain coupled to the lighting transistor.

9. A pixel comprising:

a driving transistor comprising a first gate, a first source/drain and a second source/drain, wherein the first source/drain receives a first operation voltage;

a lighting transistor coupled to the driving transistor and receiving a lighting signal;

a light-emitting diode comprising an anode coupled to the lighting transistor and a cathode receiving a second operation voltage;

a compensation transistor coupled between the first gate and the second source/drain and receiving a scan signal;

a first reset transistor comprising a second gate, a third source/drain and a fourth source/drain, wherein the second gate receives a reset signal, the third source/drain receives a first predetermined voltage, and the fourth source/drain is coupled to the first gate;

a first capacitor coupled between the first gate and the first source/drain; and a second capacitor coupled between the first gate and a node, wherein:

in a reset period, the first reset transistor is turned on to transmit the first predetermined voltage to the first gate and the anode of the light-emitting diode receives a second predetermined voltage, in a write period, the compensation transistor and the driving transistor are turned on, and a voltage of the first gate is equal to a first difference between the first operation voltage and a threshold voltage of the driving transistor, and in a display period, the driving transistor and the lighting transistor are turned on to light the light-emitting diode, wherein the second predetermined voltage is lower than or equal to the second operation voltage.

10. The pixel as claimed in claim 9, further comprising:

a second reset transistor comprising a third gate, a fifth source/drain and a sixth source/drain, wherein the third gate receives the reset signal, the fifth source/drain receives a reference voltage and the sixth source/drain is coupled to the node, wherein in the reset period, the second reset transistor is turned on to transmit the reference voltage to the node.

11. The pixel as claimed in claim 9, further comprising:

a first set transistor comprising a fourth gate, a seventh source/drain and an eighth source/drain, wherein the fourth gate receives the lighting signal, the seventh source/drain receives a reference voltage and the eighth source/drain is coupled to the node, wherein in the display period, the first set transistor is turned on to transmit the reference voltage to the node.

12. The pixel as claimed in claim 9, further comprising:

a second set transistor coupled to the anode, wherein in the reset period, the second set transistor transmits the second predetermined voltage to the anode.

13. The pixel as claimed in claim 9, further comprising:

a data input transistor coupled to the node, wherein in the write period, the data input transistor is turned on to transmit a data signal to the node.

* * * * *